US007147065B2

(12) United States Patent
Tjader

(10) Patent No.: US 7,147,065 B2
(45) Date of Patent: Dec. 12, 2006

(54) CONNECTION DESIGN AND SONDE HOUSING ASSEMBLY FOR A DIRECTIONAL DRILL

(75) Inventor: Michael Tjader, New Richmond, WI (US)

(73) Assignee: TT Technologies, Inc., Aurora, IL (US)

( * ) Notice: Subject to any disclaimer, the term of this patent is extended or adjusted under 35 U.S.C. 154(b) by 243 days.

(21) Appl. No.: 10/757,378

(22) Filed: Jan. 14, 2004

(65) Prior Publication Data

US 2004/0226750 A1 Nov. 18, 2004

Related U.S. Application Data

(60) Provisional application No. 60/459,131, filed on Mar. 31, 2003, provisional application No. 60/439,837, filed on Jan. 14, 2003.

(51) Int. Cl.
*E21B 17/20* (2006.01)

(52) U.S. Cl. ..... 175/57; 175/320

(58) Field of Classification Search ..... 166/338, 166/341, 242.1
See application file for complete search history.

(56) References Cited

U.S. PATENT DOCUMENTS 3,363,703 A * 1/1968 Shewmake ..... 175/44
3,664,444 A 5/1972 Henson
4,601,491 A * 7/1986 Bell et al. ..... 285/24
4,611,622 A * 9/1986 Ahn ..... 137/145
4,611,662 A 9/1986 Harrington
4,900,066 A * 2/1990 Brammer et al. ..... 285/92
4,986,690 A 1/1991 Cooksey
5,242,026 A 9/1993 Deken et al.
5,253,721 A 10/1993 Lee
5,469,926 A 11/1995 Lessard
6,102,135 A 8/2000 Shaw
6,170,570 B1 1/2001 Aguesse et al.
2002/0043408 A1 4/2002 Wentworth et al.

FOREIGN PATENT DOCUMENTS

WO WO-2004/065835 A3 8/2004

* cited by examiner

*Primary Examiner*—Frank Tsay
(74) *Attorney, Agent, or Firm*—Schwegman, Lundberg, Woessner & Kluth, P.A.

(57) ABSTRACT

Drill stem elements and connections are shown with advantages such as being mechanically robust. The absence of a side access window in a sonde housing is one design feature that provides robust mechanical properties. Further advantages of sonde housings include being easy to disassemble for access to the sonde unit, or for insertion of the sonde unit. In one embodiment, a cap portion is easily secured or removed using a small allen wrench, or a hammer and a punch. The cap portion is not substantially affected or tightened by rotation of the drill stem during a drilling operation. A further advantage includes the ability to remove cap portions and pull back flexible product such as polyethylene pipe from a small exit pit.

44 Claims, 11 Drawing Sheets

CONNECTION DESIGN AND SONDE HOUSING ASSEMBLY FOR A DIRECTIONAL DRILL

This application claims priority to U.S. Provisional Application No. 60/439,837 filed on Jan. 14, 2003 and U.S. Provisional Application No. 60/459,131 filed on Mar. 31, 2003 both of which are incorporated herein by reference.

TECHNICAL FIELD

This invention relates to ground drilling equipment. Specifically, this invention relates to connection designs for components of drill stems such as detection equipment in directional drills.

BACKGROUND

One component of a drill stem includes a sonde housing. Sonde units are used to provide feedback information for devices such as directional drills. A sonde unit typically transmits information such as depth, lateral distance, "clock" rotation about a drilling axis, etc. The information is used for applications such as steering a directional drill.

In a directional drilling operation, the sonde unit is typically housed at the tip of the drill stem, just behind the steering blade. Ground drilling requires large amounts of forward linear force, as well as large amounts of torque as applied to the drill stem. The housing for the sonde unit therefore requires a robust design that can withstand the forces needed for the drilling operation. In addition to the requirements of the drilling operation, the sonde unit contains sensitive circuitry and components that require careful handling.

Sonde housing designs have included both front loading and side loading configurations. Side loading configurations include a cylinder shaped housing with a diameter that is substantially the same as a drill stem diameter, with an opening cut into the side of the cylinder for insertion of the sonde. A cover is secured over the opening with screws or bolts to enclose the sonde during the drilling operation. The side opening design, however, does not provide the same level of strength in response to torque as compared to a cylinder without an opening cut into the side.

Front loading sonde housing designs do not have sonde insertion openings cut into the side. The sonde is inserted into an opening in the front of the cylindrical housing, and a threaded cap is secured over the front opening by threading the cap into the periphery of the cylinder. In this way, current front loading sonde housings enclose the sonde during the drilling operation. However, the threaded cap is difficult to remove after the drilling operation is complete due to tightening of the threads during rotation of the drill stem in a drilling operation. Large tools such as a pipe wrench are frequently needed to remove the threaded cap. Pipe wrenches or similar methods requiring large forces are inconvenient, and may be dangerous to the operator.

In addition to sonde housings, other drill stem components such as steering blade holders, sections of drill rod, etc. are selectively coupled together in a drill stem. Several combinations of these components are coupled together in the drill stem using configurations and methods that also exhibit the problems described above.

What is needed is a drill stem component connection system and method that provides structural integrity for drilling operations, while providing ease of assembly and disassembly.

DETAILED DESCRIPTION

Figure 1A:
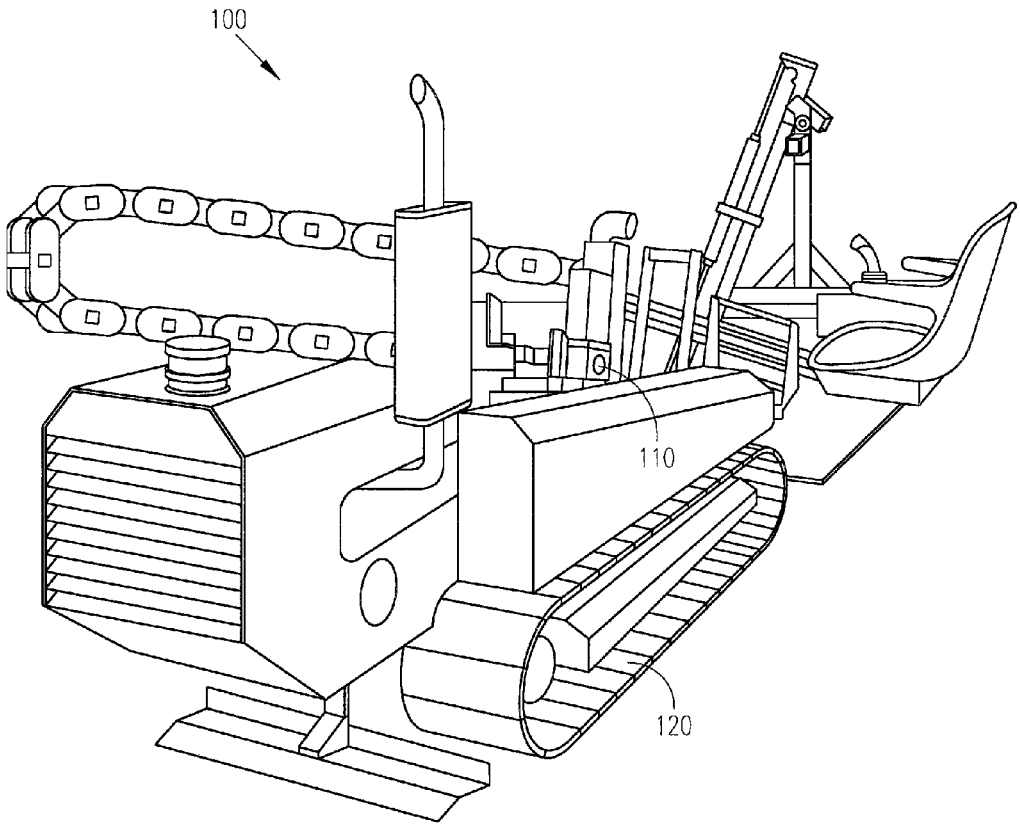
FIG. 1A shows a drilling device according to an embodiment of the invention.

In the following detailed description, reference is made to the accompanying drawings which form a part hereof, and in which is shown, by way of illustration, specific embodiments in which the invention may be practiced. In the drawings, like numerals describe substantially similar components throughout the several views. These embodiments are described in sufficient detail to enable those skilled in the art to practice the invention. Other embodiments may be utilized and structural, or logical changes, etc. may be made without departing from the scope of the present invention. In the following descriptions, a drill stem is defined to include any component that is advanced from a drilling device. A drill rod is defined as a section of pipe, solid material, etc. where sections of drill rod are coupled together to form a main part of a drill stem. Various drill stem components such as a drilling blade holder, a sonde housing, etc. can be attached to the front end of a number of drill rods during one embodiment of a typical drilling operation.

FIG. 1A shows a drilling device. Although an example of a directional drill 100 is used in the following descriptions, other ground drills utilizing a number of sections of drill stem are also contemplated to be within the scope of the invention. The directional drill 100 of FIG. 1A is shown on a track system 120 for positioning the directional drill 100. Although a track system 120 is shown, other systems are also possible for use in positioning the directional drill 100. Wheeled systems, or combinations of tracked and wheeled systems are examples of acceptable positioning systems.

Figure 1B:
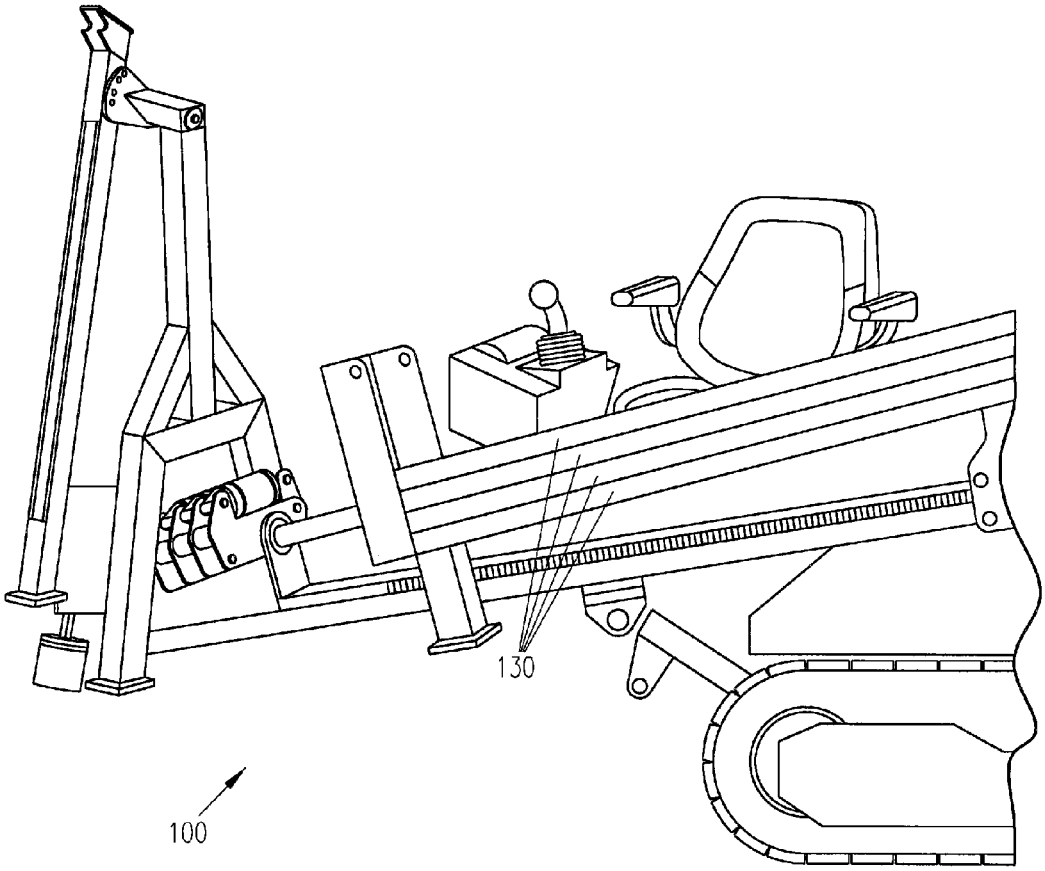
FIG. 1B shows a side view of a drilling device according to an embodiment of the invention.

A drilling drive block 110 is shown on the directional drill 100. The drilling drive block 110 is used to rotate a drill stem and to advance the drill stem during a drilling operation. Advancement of a drill stem is typically linear. In the example of a directional drill 100, the advancement of the drill stem is also typically at an angle of incidence to the ground as shown in FIG. 1A. FIG. 1B further shows the directional drill 100. A storage area or hopper 130 is shown for housing sections of drill rod as shown.

Figure 2:
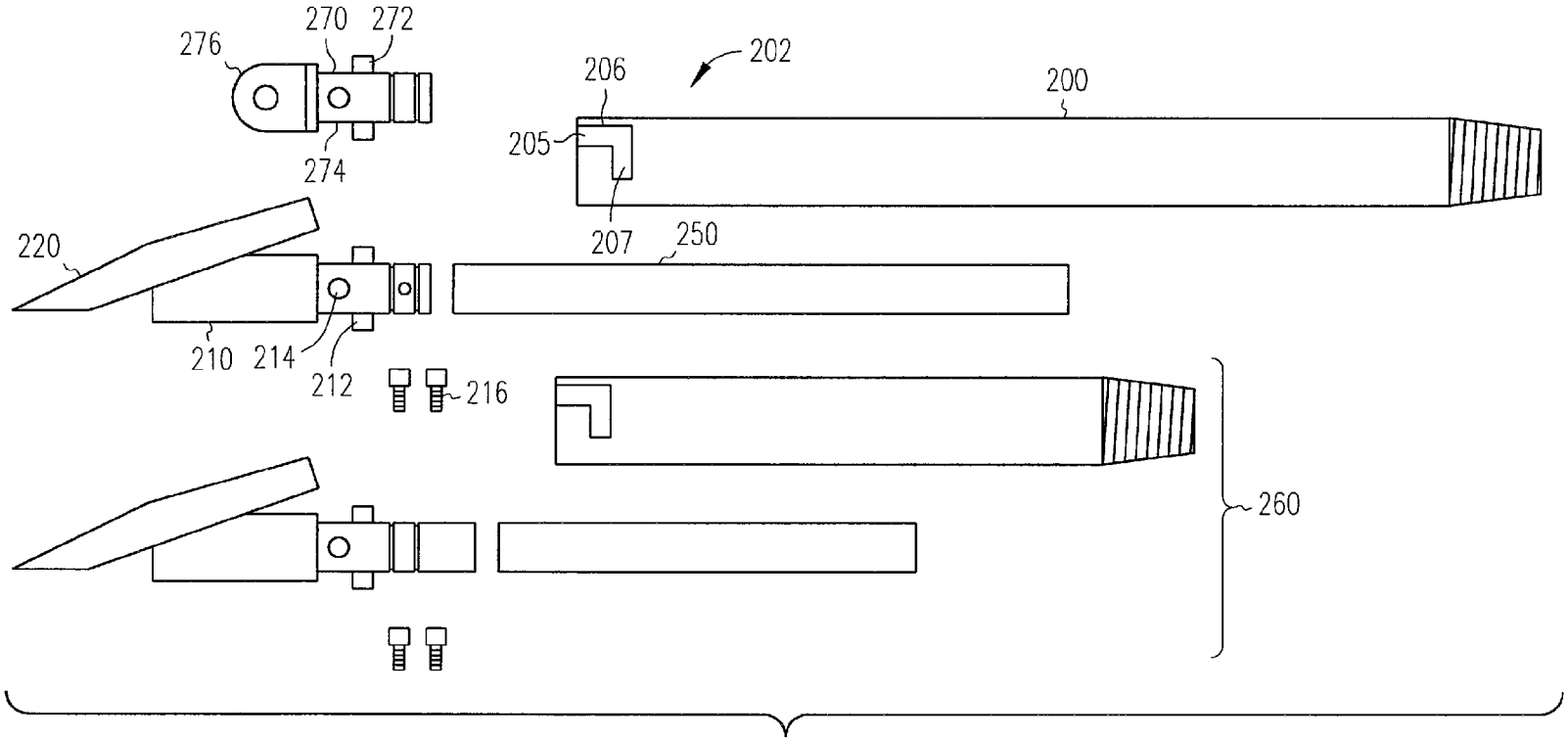
FIG. 2 shows various drill stem elements according to embodiments of the invention.

FIG. 2 shows a sonde housing 200. A sonde unit 250 is also shown along side the sonde housing 200. The sonde housing 200 includes a front end 202 and a rear end 204. In one embodiment, the rear end 204 includes a tapered thread, and is adapted to secure to a drill stem as is know in the art. The front end 202 includes at least one slot 206. In one embodiment the front end includes two slots 206 that are located substantially opposite one another at the front end 202. Three or more slots may also be included within the scope of the invention. In one embodiment, the slot 206 is shaped in an "L" shaped configuration as shown in FIG. 2. Other slot configurations include a slot with at least two directions of insertion such as the two "legs" of an "L" shaped slot.

A blade holder 210 is further shown in FIG. 2. The blade holder 210 includes a slot engaging feature 212 such as a pin. In one embodiment the blade holder 210 includes a pair of pins located substantially opposite one another to engage the pair of slots 206 on the sonde housing 200. The blade holder 210 further includes at least one receiving portion 214 such as a threaded hole. The receiving portion 214 as shown in FIG. 2 is substantially flush with an outer diameter of the blade holder 210. At least one removable locking device 216 is also shown in FIG. 2. In one embodiment, the removable locking device 216 includes a bolt or set screw, such as an allen head bolt. In one embodiment, an allen head bolt is used that is adapted to engage a threaded hole in the blade holder 210.

In operation, the sonde unit 250 is inserted into the front end 202 of the sonde housing 200. The blade holder 210 is then inserted into the front end 202 of the sonde housing 200 to enclose the sonde unit. For insertion of the cap portion, the slot engaging feature or features such as the pair of pins 212 are aligned with the slots 206 in the front end of the sonde housing 200. The pins are fully inserted into the slots 206 by completely following the slots 206 into the "L" shaped configuration. This is accomplished by first pushing the blade holder 210 along a first portion of the slot 205, then rotating the cap portion about the long axis of the sonde housing 200 to move the pins along a second portion of the slot 207. In one embodiment, the first portion of the slot 205 and the second portion of the slot 207 are substantially perpendicular to each other, and form an "L" shape as shown in FIG. 2.

Once the pins are fully inserted into the slots 206, the pins 212 are located within the second portion of the slots 207. In the configuration shown in FIG. 2, the receiving portion or portions 214 are then aligned with the first portion of the slots 205. One or more removable locking devices 216 are then engaged with the receiving portion or portions 214.

In the embodiment shown, because the pins 212 are located within the second portion of the slots 207, the blade holder 210 is prevented from moving in an direction along the long axis of the sonde housing 200. Once the alien bolt 216, or other removable locking device 216 is engaged within the first portion of the slot 205, the blade holder 210 is also prevented from moving in a rotational direction. The blade holder 210 is effectively locked in place until the allen bolt 216 is removed.

The allen bolt 216 is not affected by use or rotation of the directional drill in the manner that a threaded bore cap is affected. The alien bolt is not tightened by rotation of the drill stem during the drilling operation. Large torques from tools such as a pipe wrench are not required. It is therefore easy to remove the alien bolt 216 once the drilling operation is complete. The allen bolt 216 is also inexpensive to replace if it becomes damaged or lost.

In FIG. 2, a steering blade 220 is further shown coupled to the blade holder 210. In one embodiment, the sides of the sonde housing 200 include a number of epoxy filled openings as will be understood by one skilled in the art to allow for transmission and detection of the sonde unit. In one embodiment, the sonde housing 200 further includes passages along an exterior portion of the sonde housing 200 for the transmission of fluid as will be understood by one skilled in the art. Further to facilitate the transmission of fluid for drilling operations, the blade holder 210 in one embodiment, includes a number of O-rings and a passage to guide the fluid to the steering blade. Fluid is often used to loosen the soil in the vicinity of the steering blade, thus making the drilling operation easier.

Various lengths of sonde housings are possible within the scope of the invention. A shorter sonde assembly 260 is further shown in FIG. 2. An embodiment of a cap portion 270 is also shown in FIG. 2. The cap portion 270 includes similar attachment features as described above. A number of pins 272 are included, as well as a number of removable locking features 274 such as an allen bolt in a threaded hole. The cap portion 270 further includes an attachment feature 276 such as an eye hole. In one embodiment, the attachment feature 276 is used to pull a pipe or other desired product back through the bored hole after a directional drilling operation.

Use of the cap portion 270 to pull back a pipe or other product is beneficial because it can be used in small exit pits. As an example, a cap portion such as blade holder 210 including a steering blade 220 can be used to bore a hole through the ground into a small exit pit. Because the blade holder 210 is short relative to the length of the sonde housing 200 and does not require large tools or space for removal, it can be removed in the small exit pit. The cap portion 270 can then be installed as described above, and used to pull back a pipe or other product.

Figure 3:
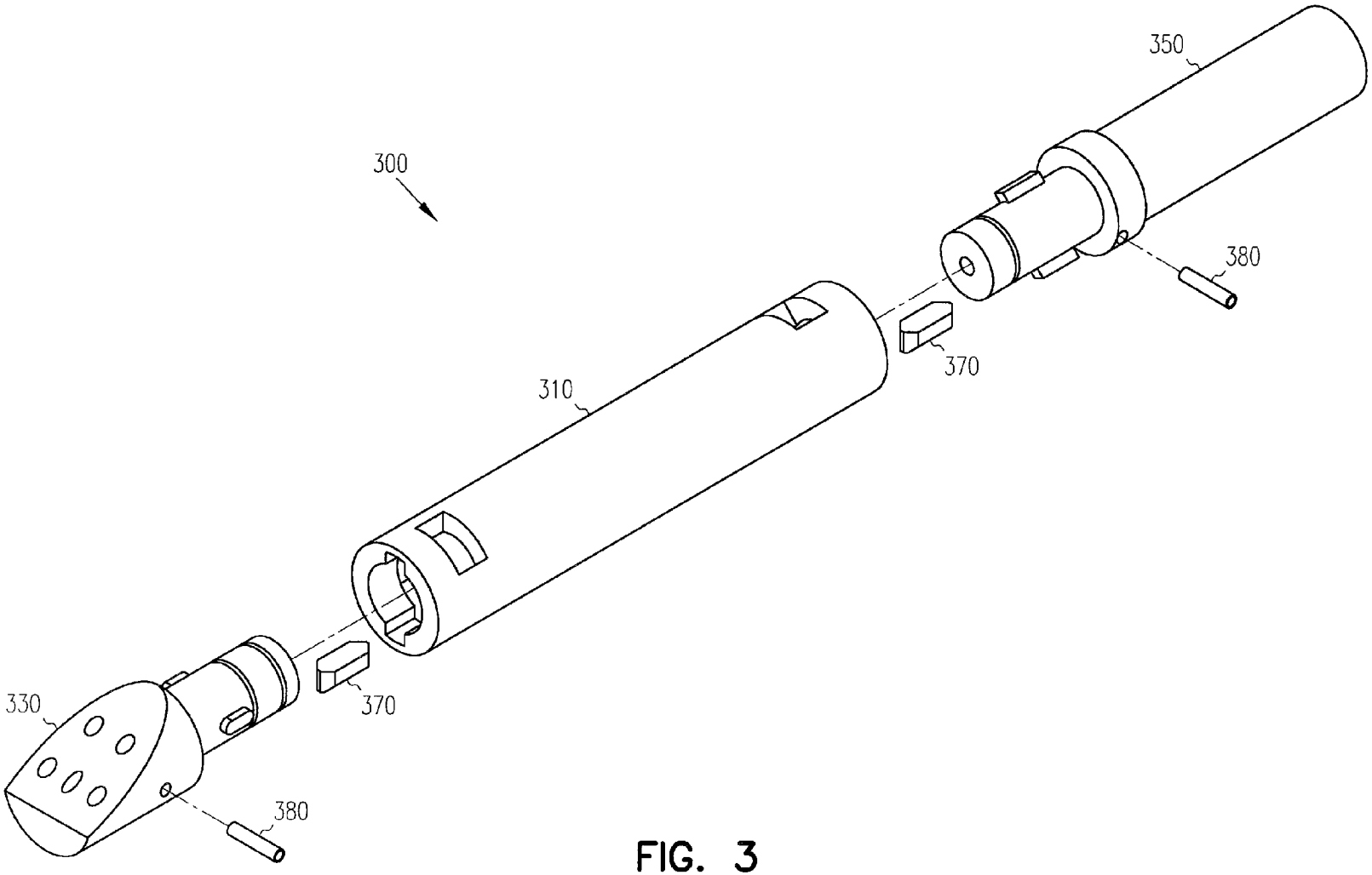
FIG. 3 shows an isometric exploded view of various drill stem elements according to an embodiment of the invention.

Another embodiment of a sonde housing assembly 300 is shown in FIG. 3. A housing portion 310 is shown with a cap portion 330 and a rear portion 350. A number of keying units 370 and a number of securing devices 380 are also shown in FIG. 3.

Figure 4:
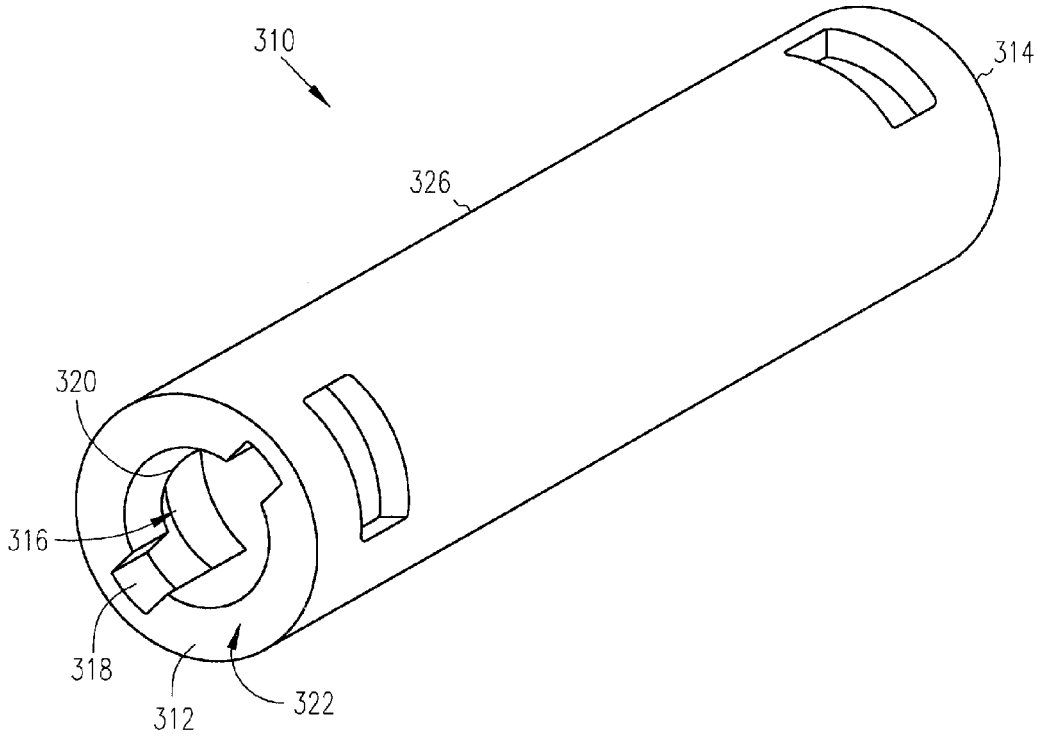
FIG. 4 shows an isometric view of a component of a sonde housing assembly according to an embodiment of the invention.

FIG. 4 shows the housing portion 310 from FIG. 3. The housing portion 310 includes a leading end 312 and a trailing end 314. A hollow middle portion 326 is included to house equipment such as a sonde unit as described above. The leading end 312 includes a first engaging feature 316 and a second engaging feature 322. In FIG. 4, the first engaging feature 316 and the second engaging feature 322 are substantially the same, and spaced opposite one another on a periphery of the housing portion 310. In one embodiment, the first engaging feature 316 and the second engaging feature 322 include a pair of slots.

The first engaging feature 316 includes a first slot portion 318 and a second slot portion 320. In one embodiment, the first slot portion 318 and the second slot portion 320 are perpendicular to each other, although the invention is not so limited. In one embodiment, the first slot portion 318 is only partially cut into a sidewall of the housing portion 310 as shown in FIG. 4. In one embodiment, the second slot portion 320 is cut all the way through the sidewall of the housing portion 310 as shown in FIG. 4. In one embodiment, both the first slot portion 318 and the second slot portion 320 are partially cut into the sidewall. In one embodiment, both the first slot portion 318 and the second slot portion 320 are cut all the way through the sidewall. Factors that influence what portion of the sidewall is removed include ease of machining the cuts into the sidewall, and structural integrity of the sidewall in the final product. Several variations of slot designs are possible without departing from the scope of the invention.

In one embodiment, both the leading end 312 and the trailing end 314 include a pair of slots similar to the first engaging feature 316 as described above. In one embodiment, a single engaging feature is included on each end. In one embodiment, a plurality of engaging features are included on each end. The number of engaging features on each end may be different in one embodiment. In one embodiment, an engaging feature as described above is only present on one end, while an alternative type of engaging feature is used on the other end. One of ordinary skill in the art, upon reading the present specification, will recognize that several combinations of engaging features including those listed above are possible within the scope of the invention.

Figure 5A:
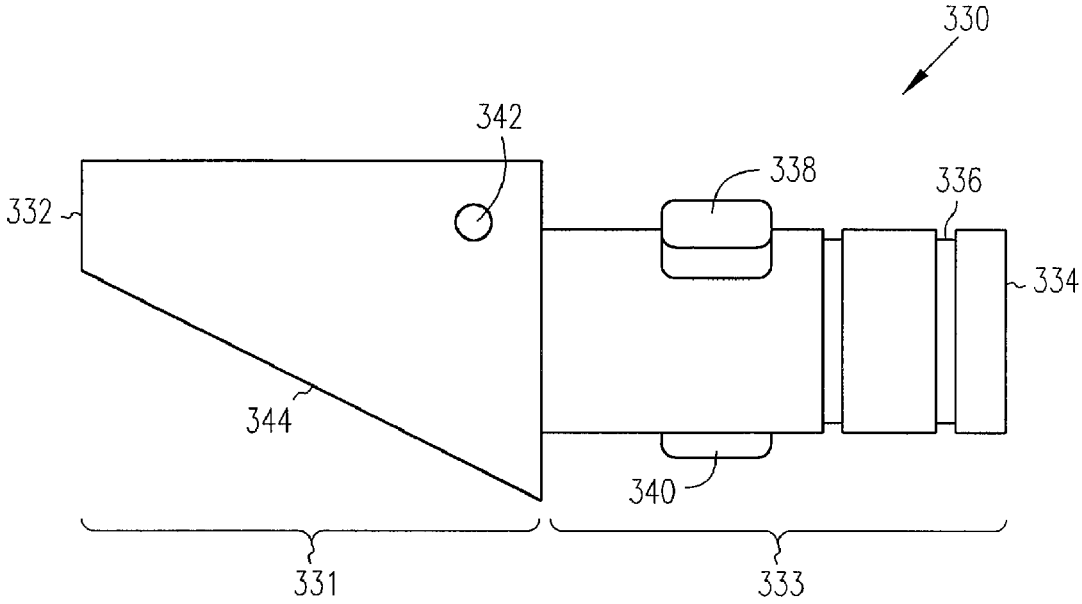
FIG. 5A shows a side view of a drill stem component according to an embodiment of the invention.

FIG. 5A shows the cap portion 330 from FIG. 3. The cap portion 330 includes a leading end 332 and a trailing end 334. The cap portion 330 is divided into a tool portion 331 and a male insertion portion 333. In one embodiment, the tool portion 331 is adapted for mounting a tool such as a directional drill blade (not shown) or other tool suitable for use with a directional drill. In one embodiment, the male insertion portion 333 is adapted for inserting into the leading end 312 of the housing portion 310 as shown in FIG. 4.

In one embodiment, the male insertion portion 333 includes at least one groove 336 for a sealing device such as a polymer O-ring. In one embodiment, two grooves 336 are included in the male insertion portion 333. In one embodiment, the male insertion portion 333 includes a first mating feature 338 and a second mating feature 340. In one embodiment, the number of mating features corresponds to a number of engaging features on the housing portion 310. Although a pair of mating features are shown, the invention is not so limited.

In one embodiment, the first mating feature 338 and the second mating feature 340 include substantially rectangular protrusions. Square protrusions or other geometries are also acceptable. In one embodiment, the first mating feature 338 and the second mating feature 340 are machined from a single metal starting block. Machining from a single metal starting block is advantageous because it provides enhanced strength to the cap portion 330. Some designs that separately attach mating features are weaker at the attachment location. Square or rectangular mating features have a further advantage over selected other geometries because a linear edge of a square or rectangular mating feature provides a large surface to transmit forces during operation of a directional drill. For example, a linear edge is stronger than a small round pin, when used to transmit a force such as torque caused by rotation of a direction drill stem.

An opening 342 is included in the tool portion 331. In one embodiment, the opening 342 includes a round hole. Use of the opening to secure the cap portion 330 in place in the sonde housing assembly 300 will be discussed below. In one embodiment designed for directional drilling, the tool portion 331 includes an angled surface 344 adapted for mounting a directional drilling blade (not shown).

Figure 5B:
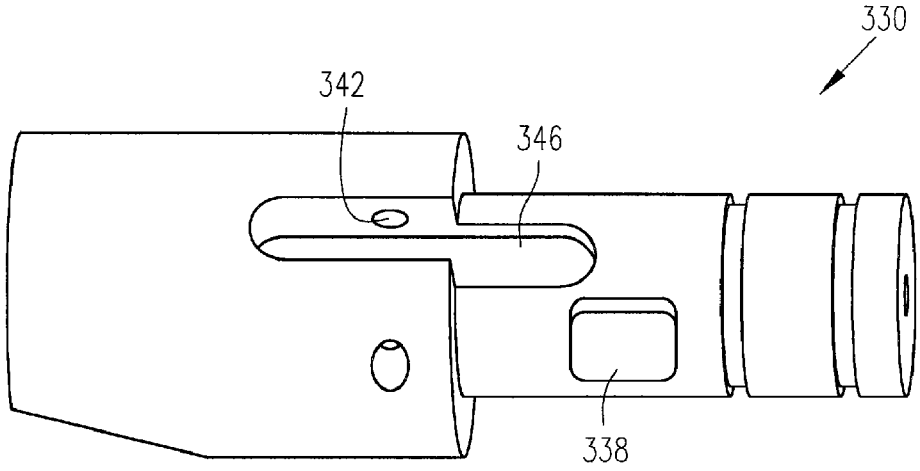
FIG. 5B shows an isometric view of the component from FIG. 5A according to an embodiment of the invention.

FIG. 5B shows the cap portion 330 from an alternative angle. A keying feature 346 is shown in FIG. 5B. The opening 342 is shown passing through a portion of the keying feature 346.

Figure 6A:
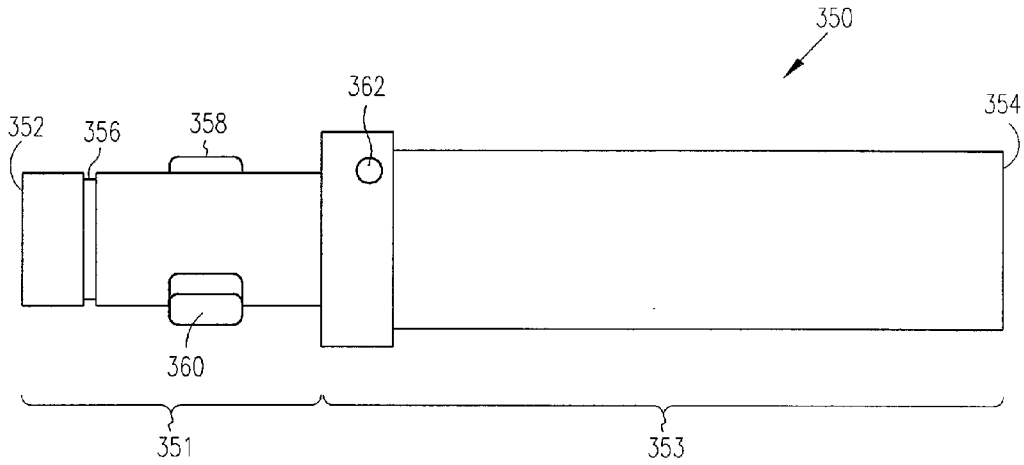
FIG. 6A shows a side view of a drill stem component according to an embodiment of the invention.

FIG. 6A shows the rear portion 350 from FIG. 3. The rear portion 350 includes a leading end 352 and a trailing end 354. The rear portion 350 is divided into a male insertion portion 351 and a drill stem portion 353. In one embodiment, the drill stem portion 353 is adapted for mounting to a section of drill stem for a directional drill (not shown). In one embodiment, the male insertion portion 351 is adapted for inserting into the trailing end 314 of the housing portion 310 as shown in FIG. 4.

In one embodiment, the male insertion portion 351 includes at least one groove 356 for a sealing device such as a polymer O-ring. In one embodiment, the male insertion portion 351 includes a first mating feature 358 and a second mating feature 360. In one embodiment, the number of mating features corresponds to a number of engaging features on the housing portion 310. Although a pair of mating features are shown, the invention is not so limited.

In one embodiment, the first mating feature 358 and the second mating feature 360 include substantially rectangular protrusions. Square protrusions or other geometries are also acceptable. Advantages of rectangular or square mating features are discussed above. In one embodiment, the first mating feature 358 and the second mating feature 360 are machined from a single metal starting block. Machining from a single metal starting block is advantageous because it provides enhanced strength to the rear portion 350.

An opening 362 is included in the rear portion 350. In one embodiment, the opening 362 includes a round hole. Use of the opening to secure the rear portion 350 in place in the sonde housing assembly 300 will be discussed below. In one embodiment designed for directional drilling, the drill stem portion 353 includes a tapered female thread adapted for mounting a section of drill rod (not shown).

Figure 6B:
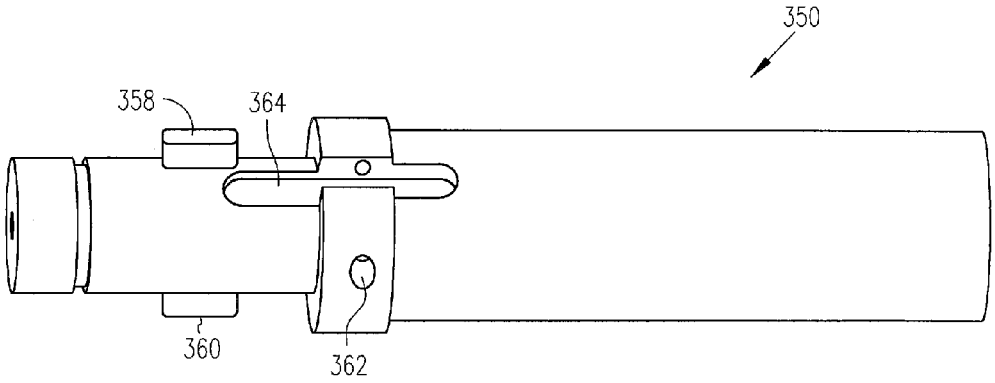
FIG. 6B shows an isometric view of the component from FIG. 6A according to an embodiment of the invention.

FIG. 6B shows the rear portion 350 from an alternative angle. A keying feature 364 is shown in FIG. 6B. The opening 362 is shown passing through a portion of the keying feature 364.

Figure 7:
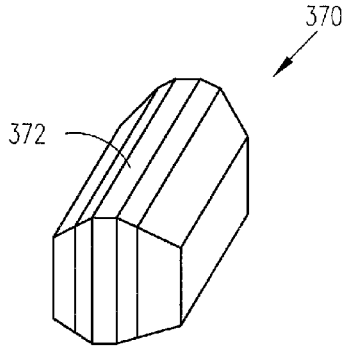
FIG. 7 shows an isometric view of a drill stem component according to an embodiment of the invention.

FIG. 7 shows the key 370 from FIG. 3. In one embodiment the key 370 is adapted to fit within at least a portion of the keying feature 364. In one embodiment, the key 370 is also adapted to fit within at least a portion of the keying feature 346. In one embodiment, both the keying feature 264 and the keying feature 346 are substantially the same, although the invention is not so limited. An advantage of keying features being substantially the same includes the ability to use one key 270 design for both keying features 364, 346. In one embodiment, the key 370 includes a number of facets 372. In one embodiment, the number of facets are shaped to facilitate ease of insertion of the key 370 into keying features 364 and 346 as will be described below. In use, directional drills can become clogged with debris and dirt, making it difficult to remove a device such as a key 370 after use. In one embodiment, the facets 372 are further configured to facilitate insertion and removal in the presence of dirt and debris.

Figure 8:
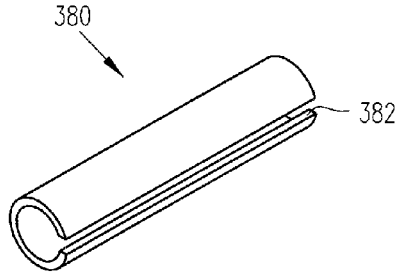
FIG. 8 shows an isometric view of a drill stem component according to an embodiment of the invention.

FIG. 8 shows a securing unit 380. In one embodiment, the securing unit 380 includes a pin. Other acceptable securing units include threaded members such as bolts or screws. In one embodiment, the securing unit 380 is adapted to fit within the opening 342. In one embodiment, the securing unit 380 is also adapted to fit within the opening 362. In one embodiment, both the opening 264 and the opening 346 are substantially the same, although the invention is not so limited. In one embodiment, the securing unit 380 includes a roll pin. A roll pin typically includes a slot 382, which allows the roll pin to compress and expand axially to provide a retention force. In one embodiment, the roll pin forms a compression fit within the openings that keeps the roll pin in place during a drilling operation. The roll pin can be easily driven out of the opening using a hammer and a punch after a drilling operation is complete.

Figure 9A:
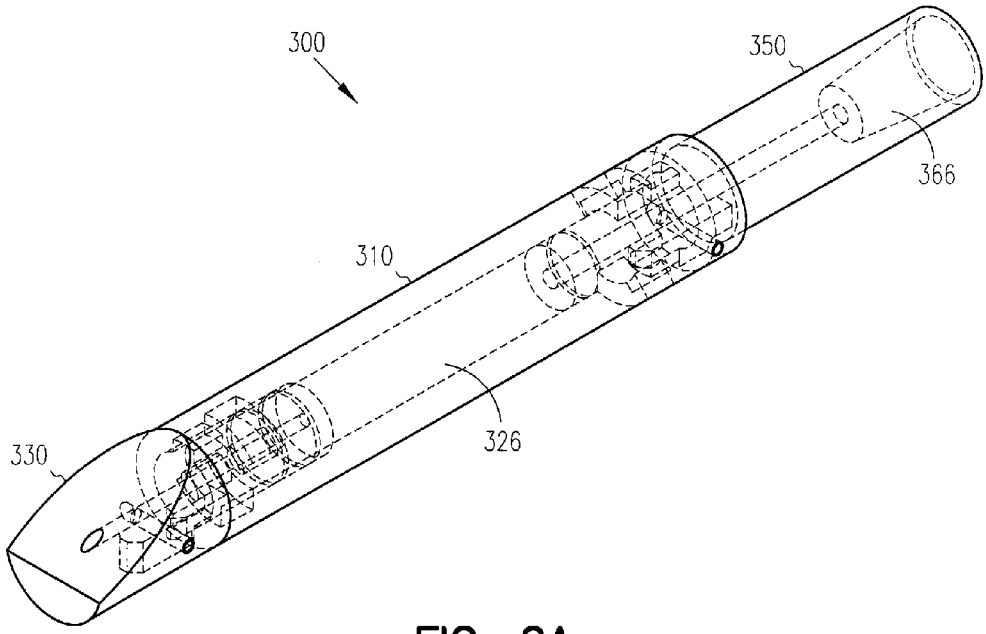
FIG. 9A shows an isometric view of assembled drill stem components according to an embodiment of the invention.
Figure 9B:
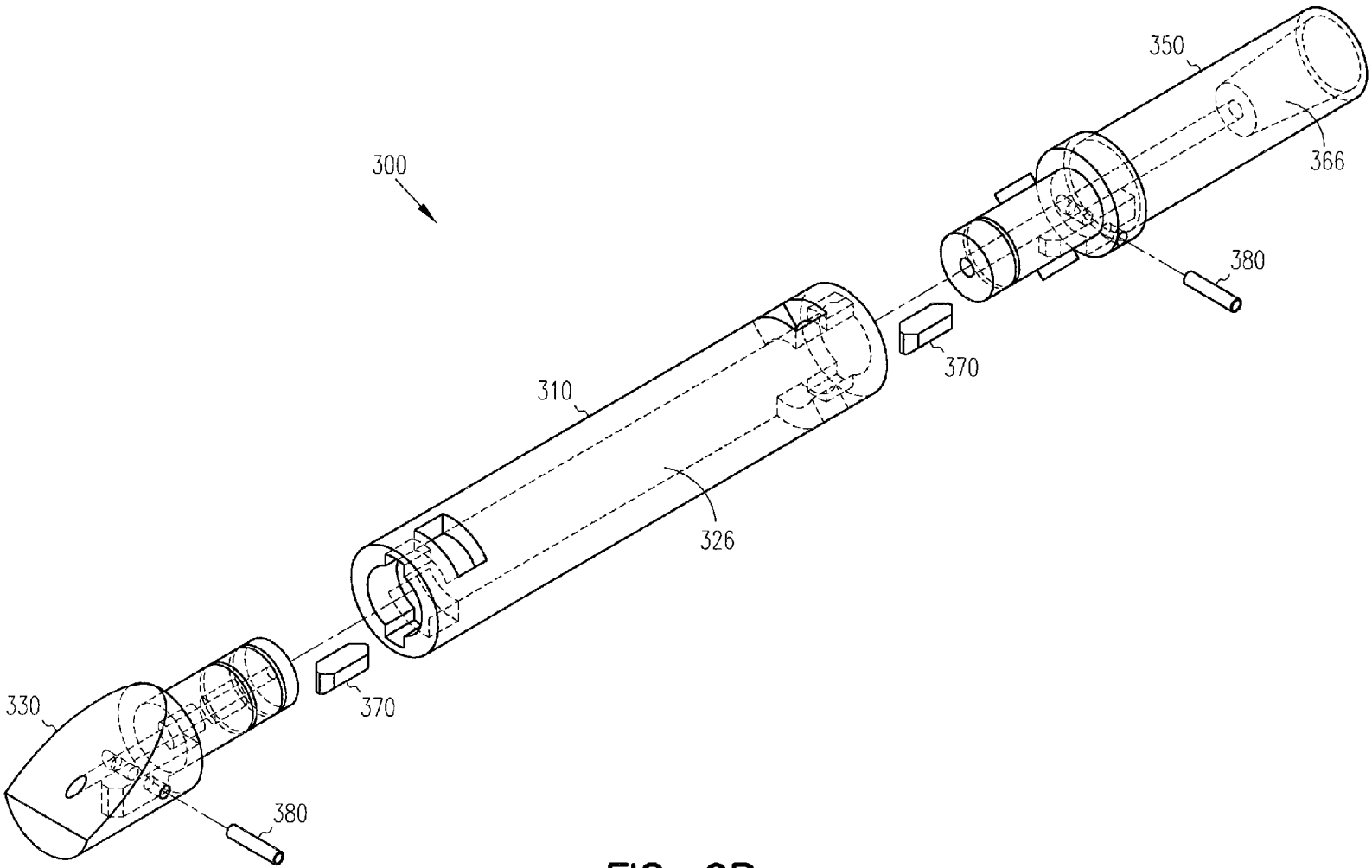
FIG. 9B shows an exploded isometric view of drill stem components according to an embodiment of the invention.

FIG. 9A shows an assembled sonde housing assembly 300 according to embodiments described above. Hidden lines are shown to further illustrate how elements of the sonde housing assembly 300 fit together. The hollow middle portion 326 of the housing portion 310 is shown. A female tapered thread 366 for mounting selected embodiments to a section of drill stem is also shown in FIG. 9A. FIG. 9B further illustrates how elements of the sonde housing assembly 300 fit together.

In use, the rear portion 350 is attached to a section of drill stem. In one embodiment, attachment includes threading a tapered male thread from a section of drill stem into a female tapered thread 366 as shown in FIGS. 9A and 9B. The trailing end 314 of the housing portion 310 is coupled to the rear portion 350 by inserting mating features 358 and 360 into corresponding engaging features in the trailing end 314 of the housing portion 310. In one embodiment, this includes inserting the mating features 358 and 360 into first slot portions. In one embodiment, insertion into the first slot portions includes linear insertion substantially along a long axis of the sonde housing assembly 300. In one embodiment, the housing portion 310 and the rear portion 350 are then rotated with respect to each other about the long axis. In one embodiment, the rotation is clockwise. The rotation further moves the mating features 358 and 360 into the second slot portions. Once located in the second slot portions, the housing portion 310 is retained from retraction back along the long axis. In one embodiment, the rotation direction that secures the housing portion 310 is the same direction that the drill stem rotates in during a normal drilling operation. This promotes a secure attachment of the housing portion during a drilling operation.

In order to further secure the housing portion 310 from accidental removal from the rear portion 350 during a drilling operation, the key 370 is inserted into the keying feature 364. After rotation of the housing portion 310 with respect to the rear portion 350, the keying feature is designed to line up with the first slot portion of the engaging features. Because the keying feature 364 is aligned with the first slot portion, the key will fit into both the keying feature 364 and the first slot portion at the same time. The key 370 therefore locks the housing portion 310 in its secure rotation position with respect to the rear portion 350.

To prevent the key 370 from falling out of the keying feature and the first slot portion, the securing unit 380, such as a roll pin, is placed into the opening 362. In the case of a roll pin, the compression fit of the pin within the opening 362 keeps the pin in place. As discussed above, removal of the pin and key 370 can be accomplished by driving out the pin with a hammer and a punch. Use of a roll pin as a securing unit 380 is advantageous because in harsh environments such as the dirt and debris of a directional drill, other securing methods such as a threaded hole and bolt would more easily become damaged.

In one embodiment, after the housing portion 310 is secured onto the rear portion 350 as described above, a sonde (not shown) is inserted into the hollow middle portion 326 of the housing portion 310. As discussed above, end insertion of the sonde is more structurally robust than side insertion designs.

In one embodiment, the cap portion 330 is secured to the housing portion 310 using the following procedure, similar to securing the housing portion 310 to the rear portion 350. The leading end 312 of the housing portion 310 is coupled to the cap portion 330 by inserting mating features 338 and 340 into corresponding engaging features in the leading end 312 of the housing portion 310. In one embodiment, this includes inserting the mating features 338 and 340 into first slot portions. In one embodiment, insertion into the first slot portions includes linear insertion substantially along a long axis of the sonde housing assembly 300. In one embodiment, the housing portion 310 and the cap portion 330 are then rotated with respect to each other about the long axis. In one embodiment, the rotation is clockwise. The rotation further moves the mating features 338 and 340 into the second slot portions. Once located in the second slot portions, the housing portion 310 is retained from retraction back along the long axis. In one embodiment, the rotation direction that secures the housing portion 310 is the same direction that the drill stem rotates in during a normal drilling operation. This promotes a secure attachment of the housing portion during a drilling operation.

In order to further secure the housing portion 310 from accidental removal from the cap portion 330 during a drilling operation, the key 370 is inserted into the keying feature 346. After rotation of the housing portion 310 with respect to the cap portion 330, the keying feature 346 is designed to line up with the first slot portion of the engaging features. Because the keying feature 346 is aligned with the first slot portion, the key 370 will fit into both the keying feature 346 and the first slot portion at the same time. The key 370 therefore locks the housing portion 310 in its secure rotation position with respect to the cap portion 330.

To prevent the key 370 from falling out of the keying feature 346 and the first slot portion, the securing unit 380, such as a roll pin, is placed into the opening 342. In the case of a roll pin, the compression fit of the pin within the opening 342 keeps the pin in place.

In one embodiment, the mating features are designed to take a majority of torque forces during a directional drilling operation. In this way, damage to other features such as keys 370 and securing units 380 is minimal. Because features such as the keys 370 and securing units 380 do not experience large forces such as torque forces, they are not easily damaged during a drilling operation, and they are consequently easier to remove when desired. Although the mating features and engaging features experience the majority of the torque forces, they are designed with configurations such as a large engaging surface of a rectangular feature, and/or machining from a single block of material, etc. The robust designs of mating features and engaging features described above minimizes damage during a drilling operation which makes it easy to disassemble the sonde housing assembly when desired.

Similar to other embodiments described herein, a cap portion can be used with the sonde housing assembly 300 that further includes an attachment feature such as an eye hole. In one embodiment, the attachment feature is used to pull a pipe or other desired product back through the bored hole after a directional drilling operation.

Figure 10A:
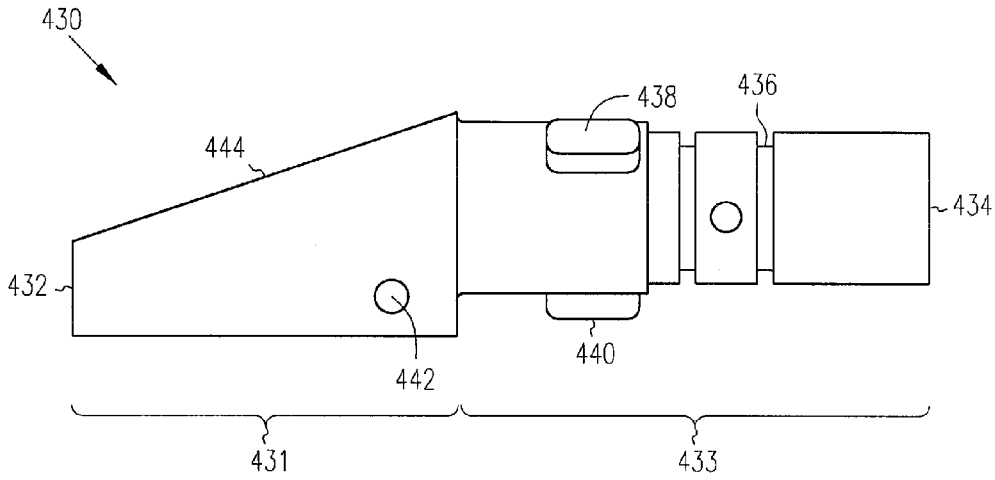
FIG. 10A shows a side view of a drill stem component according to an embodiment of the invention.
Figure 10B:
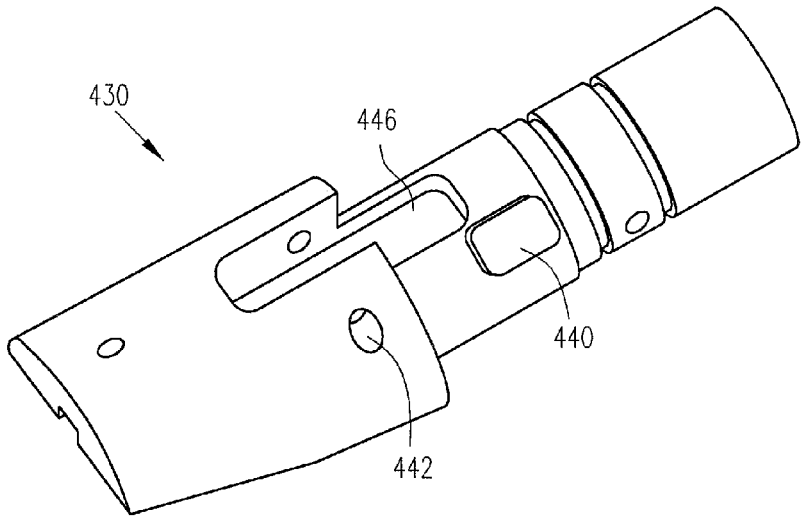
FIG. 10B shows an isometric view of the component from FIG. 10A according to an embodiment of the invention.
Figure 10C:
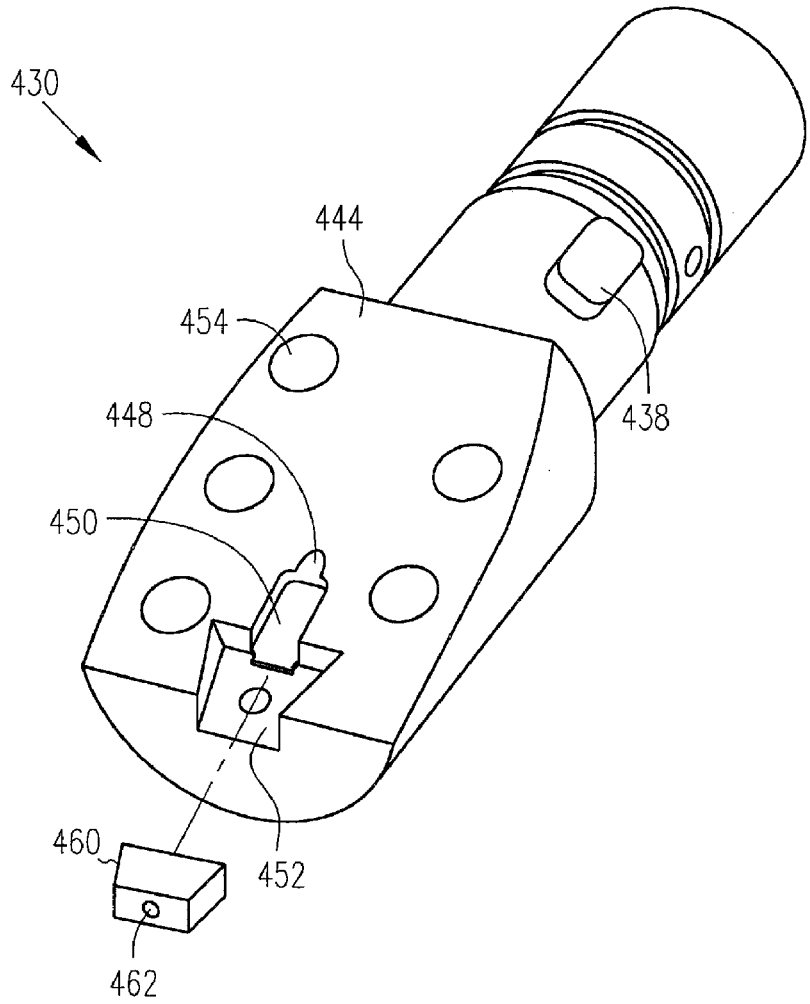
FIG. 10C shows another isometric view of the component from FIG. 10A according to an embodiment of the invention.

An embodiment of a blade holder is shown in FIGS. 10A–10C. FIG. 10A shows a blade holder 430 that may be used with embodiments described above. The blade holder 430 includes a leading end 432 and a trailing end 434. The blade holder 430 is divided into a tool portion 431 and a male insertion portion 433. In one embodiment, the tool portion 431 is adapted for mounting a tool such as a directional drill blade (not shown) or other tool suitable for use with a directional drill. In one embodiment, the male insertion portion 433 is adapted for inserting into a leading end of a housing portion such as the housing portion 310 shown in FIG. 4, or the sonde housing 200 shown in FIG. 2.

In one embodiment, the male insertion portion 433 includes at least one groove 436 for a sealing device such as a polymer O-ring. In one embodiment, two grooves 436 are included in the male insertion portion 433. In one embodiment, the male insertion portion 433 includes a first mating feature 438 and a second mating feature 440. In one embodiment, the number of mating features corresponds to a number of engaging features on a housing portion such as the housing portion 310 shown in FIG. 4. Although a pair of mating features are shown, the invention is not so limited.

In one embodiment, the first mating feature 438 and the second mating feature 440 include substantially rectangular protrusions. Square protrusions or other geometries are also acceptable. In one embodiment, the first mating feature 438 and the second mating feature 440 are machined from a single metal starting block. Machining from a single metal starting block is advantageous because it provides enhanced strength to the blade holder 430. Some designs that separately attach mating features are weaker at the attachment location. Square or rectangular mating features have a further advantage over selected other geometries because a linear edge of a square or rectangular mating feature provides a large surface to transmit forces during operation of a directional drill. For example, a linear edge is stronger than a small round pin, when used to transmit a force such as torque caused by rotation of a direction drill stem.

An opening 442 is included in the tool portion 431. In one embodiment, the opening 442 includes a round hole. Use of the opening to secure the blade holder 430 in place in a sonde housing assembly will be discussed below. In one embodiment designed for directional drilling, the tool portion 431 includes an angled surface 444 adapted for mounting a directional drilling blade (not shown).

FIG. 10B shows the blade holder 430 from an alternative angle. A keying feature 446 is shown in FIG. 10B. The opening 442 is shown passing through a portion of the keying feature 446.

FIG. 10C illustrates a passage 448 through the blade holder 430. In one embodiment, the passage 448 passes substantially through a longitudinal center of the cap portion, although the invention is not so limited. In one embodiment, a channel 450 is further coupled to the passage 448. In one embodiment, a pocket 452 is further coupled to the channel 450. In one embodiment, the passage 448 and the channel 450 are adapted to conduct a flow of liquid lubricant to a leading region of directional drilling. Lubricant is beneficial in many types of directional drilling to help loosen up the soil in front of a cutting blade. In one embodiment, the liquid lubricant includes a bentonite lubricant.

Because soil conditions can vary substantially from one drilling site to another, different amounts of lubricant flow are desired. In one embodiment, a lubricant nozzle 460 is included that is replaceable or selectable for a given blade holder 430. The lubricant nozzle 460 includes a port 462 with a diameter that allows a certain amount of lubricant to flow under given pressure conditions. The embodiment shown in FIG. 10C includes a replaceable nozzle 460 that allows a different nozzle 460 to be selected depending on soil conditions at a particular drilling site. If more lubricant is required, a nozzle 460 with a larger port 462 is selected. Conversely, if a smaller amount of lubricant is required, a nozzle 460 with a smaller port 462 is selected. The ability to select nozzles 460 reduces cost to the end user because nozzles 460 are relatively inexpensive to manufacture. The end user can purchase and have on hand a number of nozzles 460 with varying port 462 sizes for varying conditions. This is in contrast to non-replaceable designs where the end user would be forced to purchase a number of cap portions 430 that are more expensive to manufacture. In addition to permitting the end user to vary port 462 sizes, it is advantageous to be able to replace worn nozzles 460 due to wear from the lubricant or other wear sources.

In use, the selected nozzle 460 is placed in the pocket 452 before the cutting blade (not shown) is attached to the blade holder 430. In one embodiment, a number of bolt holes 454 are used to secure the cutting blade to the blade holder 430. Other attachment methods are also within the scope of the invention. One example of a cutting blade is shown in FIG. 2 as element 220. In one embodiment, the nozzle 460 is tapered to fit within a tapered pocket 452. The taper keeps the nozzle in place within the blade holder 430, while the cutting blade further holds the nozzle 460 captive during a directional drilling operation, or the like.

CONCLUSION

Embodiments of drill stem elements and connections as described above have the advantage of being mechanically robust. The absence of a side access window in a sonde housing is one design feature that provides robust mechanical properties. A substantially solid sonde housing provides increased torque properties.

Embodiments of drill stem elements and connections as described above further provide an advantage of being easy to disassemble for access to the sonde unit, or for insertion of the sonde unit. In one embodiment, using engagement feature designs, mating feature designs, and other elements, a tool holder or cap portion is easily secured or removed. The cap portion, tool holder, etc. is not substantially affected or tightened by rotation of the drill stem during a drilling operation.

Embodiments of drill stem elements and connections as described above further provide an advantage where after drilling, a steering blade cap portion is removed and an alternate cap portion is installed in its place. In one embodiment, the alternate cap portion is equipped to pull back a pipe such as a polyethylene pipe or other product through the drilled hole. Because of the easy removal of the cap portions, the pull back operation can be performed in a small exit pit.

A replaceable nozzle for drilling lubricant is also shown in one embodiment above. A replaceable nozzle allows variations of lubricant flow depending on specific drilling conditions, as well as replacement of worn nozzles.

While a number of advantages of embodiments described herein are listed above, the list is not exhaustive. Other advantages of embodiments described above will be apparent to one of ordinary skill in the art, having read the present disclosure. Although specific embodiments have been illustrated and described herein, it will be appreciated by those of ordinary skill in the art that any arrangement which is calculated to achieve the same purpose may be substituted for the specific embodiment shown. This application is intended to cover any adaptations or variations of the present invention. It is to be understood that the above description is intended to be illustrative, and not restrictive. Combinations of the above embodiments, and other embodiments will be apparent to those of skill in the art upon reviewing the above description. The scope of the invention includes any other applications in which the above structures and fabrication methods are used. The scope of the invention should be determined with reference to the appended claims, along with the full scope of equivalents to which such claims are entitled.

What is claimed is:

1. A drill stem connection assembly, comprising:

a first drill stem section;

a second drill stem section;

at least one engaging feature located at an end of the first drill stem section, wherein the engaging feature includes a substantially square feature;

at least one mating feature for accepting the at least one engaging feature, the at least one mating feature located at an end of the second drill stem section; and a securing member for selective placement in cooperation between the first drill stem section and the second drill stem section, wherein when placed in a securing position, the securing member holds the engaging feature securely mated with the mating feature.

2. The drill stem connection assembly of claim 1, wherein the first drill stem section includes a length of drill rod.

3. The drill stem connection assembly of claim 2, wherein the second drill stem section includes a sonde housing.

4. The drill stem connection assembly of claim 2, wherein the second drill stem section includes a tool holder assembly.

5. The drill stem connection assembly of claim 2, wherein the second drill stem section includes a cap assembly having an attachment feature for pulling a product through a drilled hole.

6. The drill stem connection assembly of claim 2, wherein the second drill stem section includes a length of drill rod.

7. The drill stem connection assembly of claim 1, wherein the engaging feature includes a round pin.

8. The drill stem connection assembly of claim 1, wherein the mating feature includes a slot.

9. The drill stem connection assembly of claim 1, wherein the securing member includes a threaded bolt for threading into the first drill stem section.

10. The drill stem connection assembly of claim 1, wherein the securing member includes a key for fitting into a slot in both the first drill stem section and the second drill stem section.

11. A drill stem connection assembly, comprising:

a first drill stem element and a second drill stem element for mating together to form a drill stem interface;

a slot located at an end of the first drill stem element, the slot including a first portion with a first direction of insertion and a second portion having a second direction of insertion different from the first direction of insertion;

a protruding portion located at an end of the second drill stem element, the protruding portion being shaped to engage the slot; and a securing member to selectively couple to the second drill stem element at a location within the slot.

12. The drill stem connection assembly of claim 11, wherein the first portion of the slot and the second portion of the slot are substantially perpendicular to each other.

13. The drill stem connection assembly of claim 12, wherein the first portion of the slot is substantially parallel to a drill stem axis.

14. The drill stem connection assembly of claim 11, wherein the protruding portion includes a round pin.

15. The drill stem connection assembly of claim 11, wherein the securing member includes a threaded bolt.

16. The drill stem connection assembly of claim 11, wherein the protruding portion extends outwardly from the second drill stem element.

17. The drill stem connection assembly of claim 11, wherein, when placed in a securing position, the securing member is substantially at or below a diameter of the drill stem sections.

18. A drill stem connection assembly, comprising:

a first drill stem element and a second drill stem element for mating together to form a drill stem interface;

a slot located at an end of the first drill stem element, the slot including a first portion with a first direction of insertion and a second portion having a second direction of insertion different from the first direction of insertion;

a protruding portion located at an end of the second drill stem element, the protruding portion being shaped to engage the slot; and a key for insertion between the first drill stem element and the second drill stem element to limit rotation of the first drill stem element with respect to the second drill stem element.

19. The drill stem connection assembly of claim 18, wherein the slot is substantially "L" shaped.

20. The drill stem connection assembly of claim 18, wherein the protruding portion includes a substantially square feature.

21. The drill stem connection assembly of claim 18, further including a pin for placement to hold the key in place.

22. The drill stem connection assembly of claim 18, wherein the protruding portion extends outwardly from the second drill stem element.

23. The drill stem connection assembly of claim 18, wherein, when placed in a securing position, the key is substantially at or below a diameter of the drill stem sections.

24. A drilling device, comprising:

a linear drive region with a linear range of motion;

a drilling drive block movable within the linear range of motion;

a drill stem rotation device located on the drilling drive block;

a first drill stem element and a second drill stem element for mating together to form a drill stem interface;

a slot located at an end of the first drill stem element, the slot including a first portion with a first direction of insertion and a second portion having a second direction of insertion different from the first direction of insertion;

a protruding portion located at an end of the second drill stem element, the protruding portion being shaped to engage the slot; and a securing member to selectively couple to the second drill stem element at a location within the slot.

25. The drilling device of claim 24, wherein the protruding portion includes a round pin.

26. The drilling device of claim 24, wherein the engaging feature includes a substantially square feature.

27. The drilling device of claim 24, wherein the securing member includes a threaded bolt.

28. The drilling device of claim 24, further a storage area to hold sections of drill rod and a handling device to move sections of drill rod between the storage area and the drilling drive block.

29. A method, comprising:

inserting a male portion of a first drill stem element into a female portion of a second drill stem element;

guiding a protruding portion located on the first drill stem element along a first slot direction into a first portion of a slot located on the second drill stem element;

guiding the protruding portion into a second portion of the slot along a second slot direction; and coupling a securing member to the first drill stem element, wherein the securing member is located within the first portion of the slot.

30. The method of claim 29, wherein guiding the protruding portion located on the first drill stem element along the first slot direction includes guiding the protruding portion along a first slot direction that is parallel to a drill stem axis.

31. The method of claim 30, wherein guiding the protruding portion into the second portion of the slot along the second slot direction includes guiding the protruding portion along a second slot direction that is perpendicular to the first slot direction.

32. The method of claim 29, wherein coupling the securing member to the first drill stem element includes threading a bolt into a threaded hole in the first drill stem element wherein a bolt head protrudes and is located within the first portion of the slot.

33. The method of claim 29, wherein inserting a male portion of a first drill stem element into a female portion of a second drill stem element includes inserting a male portion of a drill rod section into a female portion of a sonde housing.

34. The method of claim 29, wherein inserting a male portion of a first drill stem element into a female portion of a second drill stem element includes inserting a male portion of a drill blade holder into a female portion of a sonde housing.

35. The method of claim 29, wherein inserting a male portion of a first drill stem element into a female portion of a second drill stem element includes inserting a male portion of a drilling blade holder into a female portion of a sonde housing.

36. A drill stem connection assembly, comprising:

a first drill stem section;

a second drill stem section;

at least one engaging feature located at an end of the first drill stem section;

at least one slot for accepting the at least one engaging feature, the at least one slot located at an end of the second drill stem section; and a securing member for selective attachment to one of the drill stem sections within the slot, wherein when placed in a securing position, the securing member holds the engaging feature securely mated with the slot, and wherein, when placed in a securing position, the securing member is substantially at or below a diameter of the drill stem sections.

37. The drill stem connection assembly of claim 36, wherein the first drill stem section includes a length of drill rod.

38. The drill stem connection assembly of claim 37, wherein the second drill stem section includes a sonde housing.

39. The drill stem connection assembly of claim 37, wherein the second drill stem section includes a tool holder assembly.

40. The drill stem connection assembly of claim 37, wherein the second drill stem section includes a cap assembly having an attachment feature for pulling a product through a drilled hole.

41. The drill stem connection assembly of claim 37, wherein the second drill stem section includes a length of drill rod.

42. The drill stem connection assembly of claim 36, wherein the engaging feature includes a round pin.

43. The drill stem connection assembly of claim 36, wherein the engaging feature includes a substantially square feature.

44. The drill stem connection assembly of claim 36, wherein the securing member includes a threaded bolt for threading into the first drill stem section.

* * * * *